US011397067B2

(12) United States Patent
Wisbith

(10) Patent No.: US 11,397,067 B2
(45) Date of Patent: Jul. 26, 2022

(54) POSITION INDEXING FEATURE FOR FIREARM WITH ADJUSTABLE BUTT

(71) Applicant: Daniel Defense, LLC, Black Creek, GA (US)

(72) Inventor: Nicholas Wisbith, Black Creek, GA (US)

(73) Assignee: Daniel Defense, LLC, Black Creek, GA (US)

( * ) Notice: Subject to any disclaimer, the term of this patent is extended or adjusted under 35 U.S.C. 154(b) by 0 days.

(21) Appl. No.: 17/241,985

(22) Filed: Apr. 27, 2021

(65) Prior Publication Data

US 2021/0348878 A1 Nov. 11, 2021

Related U.S. Application Data

(60) Provisional application No. 63/022,020, filed on May 8, 2020.

(51) Int. Cl.
*F41C 23/14* (2006.01)

(52) U.S. Cl.
CPC ..... *F41C 23/14* (2013.01)

(58) Field of Classification Search
CPC ..... F41C 23/14
See application file for complete search history.

(56) References Cited

U.S. PATENT DOCUMENTS

| | | | | |
|---|---|---|---|---|
| 2018/0058806 | A1* | 3/2018 | Moody | F41C 23/14 |
| 2018/0180378 | A1* | 6/2018 | Pretelli | F41A 11/02 |
| 2021/0063111 | A1* | 3/2021 | Haugen | F41C 23/20 |
| 2021/0116210 | A1* | 4/2021 | Guillerm | F41C 23/20 |

* cited by examiner

*Primary Examiner* — J. Woodrow Eldred
(74) *Attorney, Agent, or Firm* — Merchant & Gould P.C.

(57) ABSTRACT

An apparatus that includes a position indexing feature for a firearm with an adjustable butt may be provided. The apparatus may comprise a butt pad base and a butt pad slide. The butt pad base may comprise a first slidable retention element and a marking face. The butt pad slide may comprise a second slidable retention element that slidably engages and retains the first slidable retention element, and a window through which at least a portion of the marking face is viewable.

20 Claims, 16 Drawing Sheets

POSITION INDEXING FEATURE FOR FIREARM WITH ADJUSTABLE BUTT

RELATED APPLICATION

Under provisions of 35 U.S.C. § 119(e), Applicant claims the benefit of U.S. Provisional Application No. 63/022,020 filed May 8, 2020, the disclosure of which is incorporated herein by reference.

BACKGROUND

A semi-automatic rifle may comprise a self-loading firearm whose action automatically cycles (i.e., ejects and rechambers) a new cartridge after each shot, but needs the operator to manually reset a hammer. The hammer needs to reset by relaxing the trigger before the next shot may be fired. Accordingly, only a single round may be discharged each time the trigger is depressed. In contrast, a fully-automatic (i.e., full-auto) rifle both cycles cartridges automatically and cycles (i.e., resets and releases) the hammer automatically as opposed to semi-auto firearms, which do only the former when the trigger is pulled. Consequently, for the duration of the trigger-pull, the full-auto rifle will fire multiple cartridges continuously until the full-auto rifle's magazine is depleted.

A firearm stock, often simply a stock, also known as a shoulder stock, a buttstock, is a part of a long firearm such as a rifle, to which the barreled action and firing mechanism are attached thereto and is held against the user's shoulder when shooting the firearm. The stock provides a means for the shooter to firmly support the firearm and easily aim with stability. The stock also transmits recoil into the shooter's body.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1A:
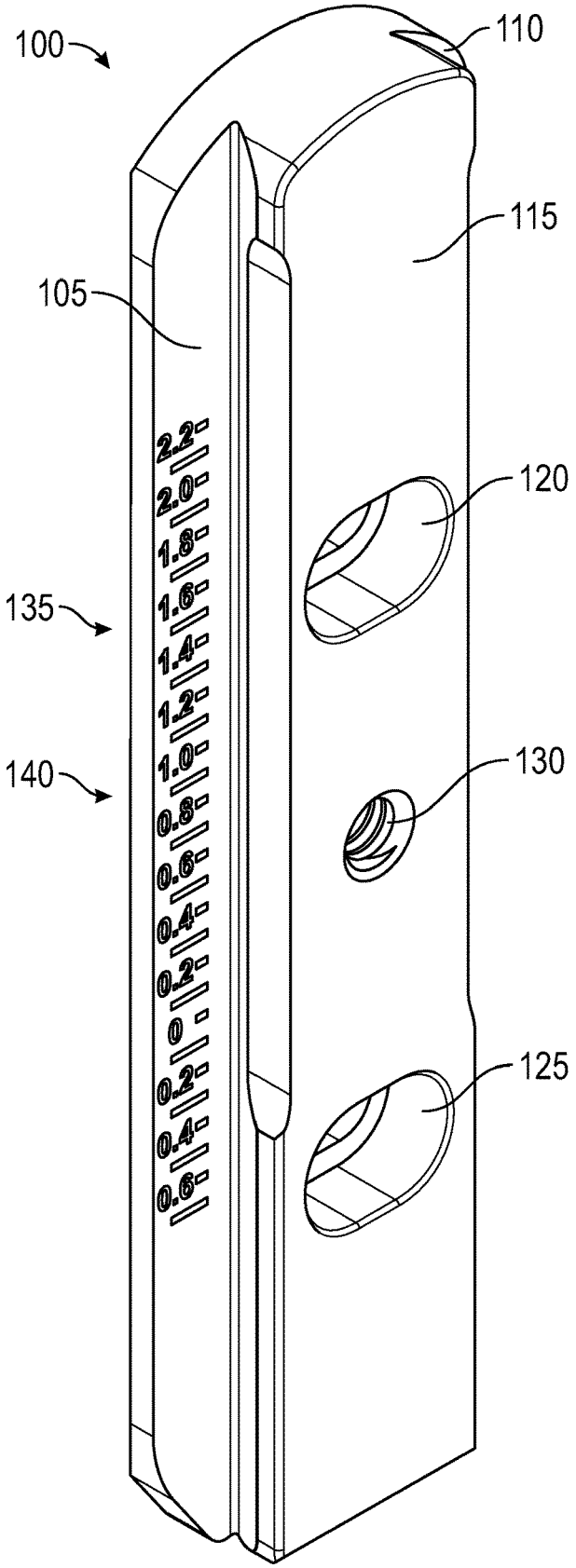
FIG. 1A shows an isometric view of a butt pad base.

An apparatus that includes a position indexing feature for a firearm with an adjustable butt may be provided. The apparatus may comprise a butt pad base and a butt pad slide. The butt pad base may comprise a first slidable retention element and a marking face. The butt pad slide may comprise a second slidable retention element that slidably engages and retains the first slidable retention element, and a window through which at least a portion of the marking face is viewable.

Both the foregoing overview and the following example embodiments are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiments.

EXAMPLE EMBODIMENTS

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Embodiments of the disclosure may allow a user (e.g., a shooter) to quickly and easily indicate and set a position of a butt (or butt assembly) on a firearm stock having a provision for vertical adjustment (i.e., indexing) of the butt position, while ensuring that the accuracy and reliability of the butt position indexing feature is preserved, and allowing an aesthetically-pleasing design to be maintained. Vertical adjustment of the butt may allow the shooter to tailor the basic "fit" of the stock to the shooter's body and may form a more natural interface between the shooter and the firearm, which may help the shooter to more easily make accurate shots with the firearm.

With a firearm, an optical sight (e.g., a scope) may be mounted in a position that may be high over a bore of the firearm. Vertical adjustment of the butt position may be desirable when aiming through the optical sight because the vertical adjustment may allow the shooter to bring an eye to meet the level of the optical sight while maintaining a natural relationship between the position of the butt against the shooter's shoulder, and the relative positions of the shoulder and eye. This may help to permit a natural shooter/stock interface, aiding in firearm accuracy. The ability to index (e.g., adjust vertically) the position of the butt may allow the shooter to make adjustments that may be more precise, recordable, more repeatable, and to make the adjustments more quickly than may be possible without embodiments of the disclosure.

Embodiments of the disclosure may include a butt pad base that may comprise a plate having, for example, a male dovetail feature centered upon it and extending the full length of the butt pad base, where the width of the male dovetail feature may be less than that of the butt pad base overall. This difference in width may create a "flat" feature (e.g., a marking face) that may be perpendicular to a centerline of a profile of the dovetail feature. The flat feature may comprise an area onto which is engraved or otherwise formed a set of markings comprising, for example, a series of numbers and horizontal line segments extending the length of the butt pad base.

Embodiments of the disclosure may further include a butt pad slide that may comprise a block of overall height and width equal to that of the butt pad base and may comprise, for example, a female dovetail feature corresponding to the male dovetail feature of the butt pad base. The butt pad slide may comprise a primary "notch cut" feature (e.g., a window) that may be located on a side of the butt pad slide. The window may include a secondary notch cut feature (e.g., a pointer).

When the butt pad base and the butt pad slide are joined via engagement between their respective dovetail features, the primary notch cut feature (i.e., the window) of the butt pad slide may reveal an area of the surface of the butt pad base (e.g., the marking face) onto which sets of numbers and line segments are marked, allowing a portion of the makings to be displayed. As either of the two parts (i.e., the butt pad base and the butt pad slide) move, constrained by their mating dovetail features, the secondary notch feature (e.g., the pointer) in the butt pad slide may be brought into alignment with the line segment markings on the butt pad base. This may provide a visible indication of the position of the two parts relative to each other. In the context of integrating the two parts in a rifle stock, embodiments of the disclosure may provide the user with a numbered or otherwise positively identifiable reading of a vertical position of the rifle's butt.

Embodiments of the disclosure may include a butt pad base that may have height position markings for indicating a vertical position of a firearm butt where, when the butt pad base is assembled as part of a rifle stock or firearm, the height position markings may be oriented other than parallel to a side of the rifle stock or firearm. Embodiments of the disclosure may further include a butt pad slide that may connect to the butt pad base and may have a geometry sufficient to cover/obscure the height position markings on the butt pad base when assembled, except that it includes one or more features which are able to be used to selectively reveal the height position markings, or to indicate/index the position of the butt pad slide relative to the height position markings. Embodiments of the disclosure may further include a dovetail (or similar) connection feature permitting linear movement of one the butt pad base and the butt pad slide relative to the other. Consequently, embodiments of the disclosure may allow for accurate, repeatable positioning of the vertically adjustable butt assembly in such a way that the markings are obscured from immediate view except as needed for positioning (aesthetically cleaner), and are protected from being rendered illegible over time due to abrasion/wearing off from normal handling/use, or by being covered by dirt/mud/debris, etc.

Figure 1B:
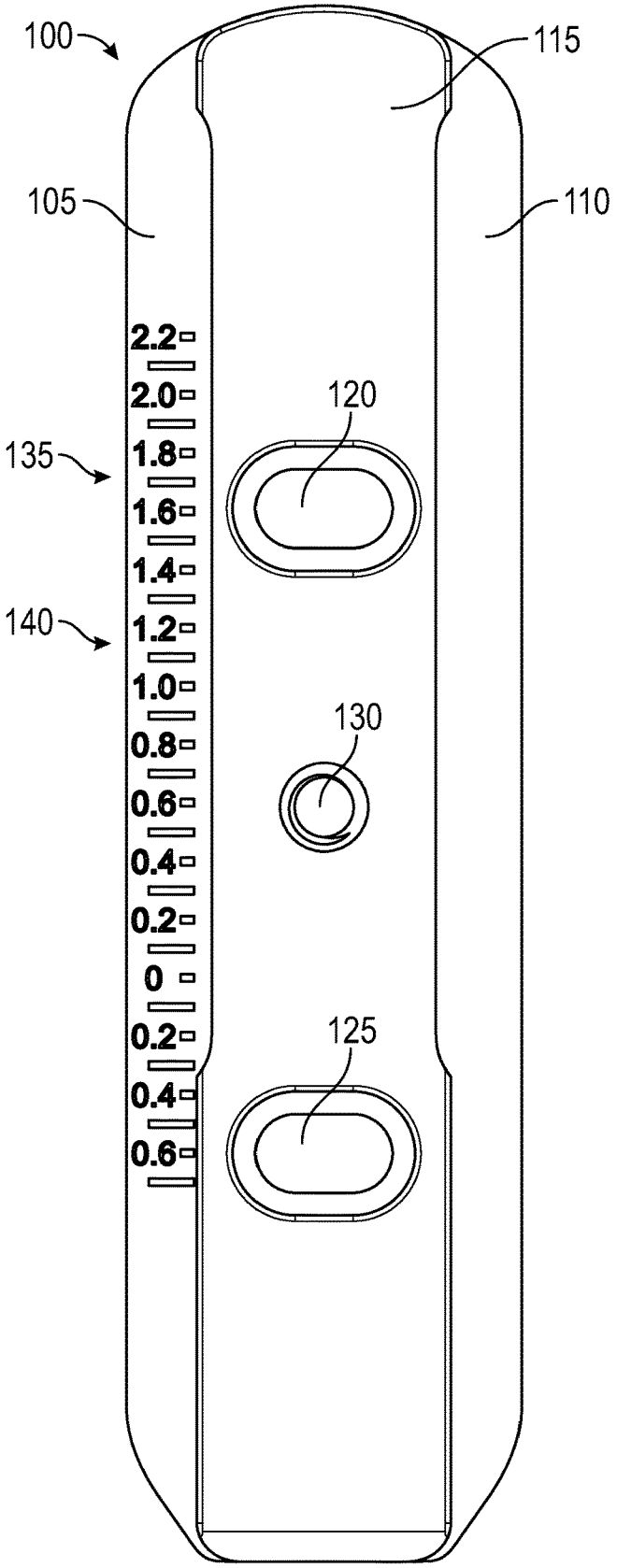
FIG. 1B shows a front view of a butt pad base.
Figure 1C:
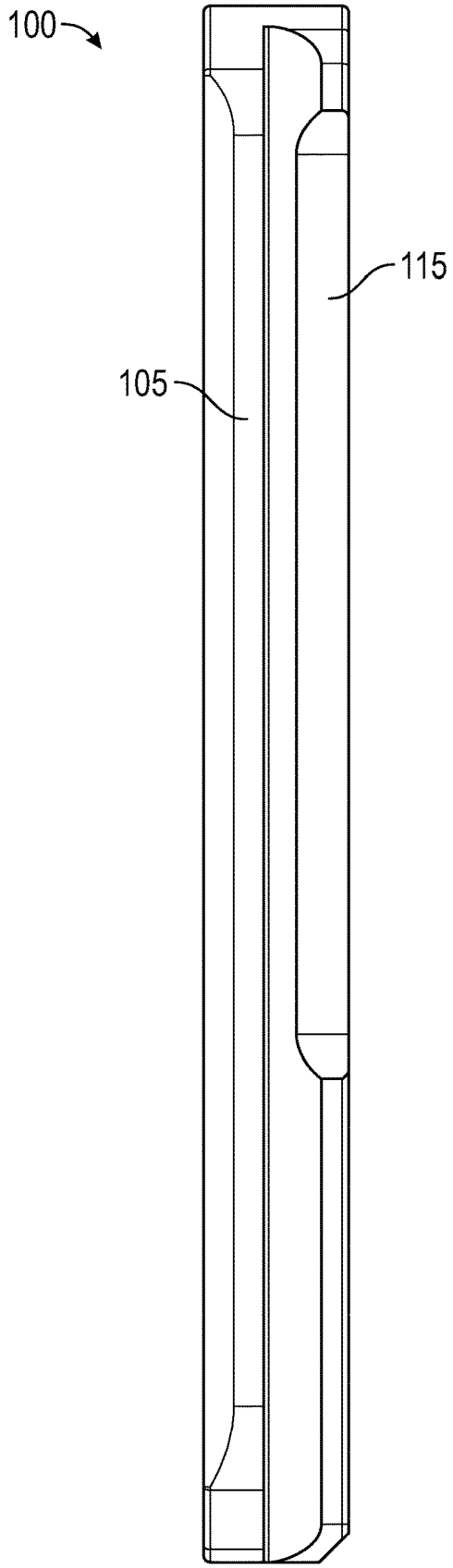
FIG. 1C shows a side view of a butt pad base.
Figure 1D:
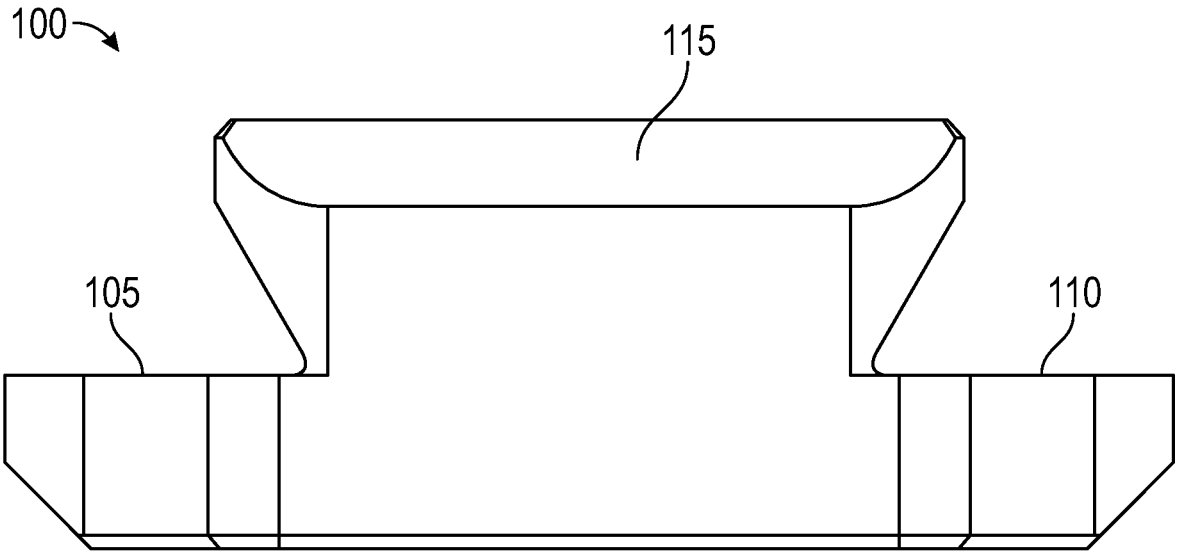
FIG. 1D shows a bottom view of a butt pad base.

FIG. 1A, FIG. 1B, FIG. 1C, and FIG. 1D show a butt pad base 100. FIG. 1A shows an isometric view of butt pad base 100, FIG. 1B shows a front view of butt pad base 100, FIG. 1C shows a side view of butt pad base 100, and FIG. 1D shows a bottom view of butt pad base 100. As shown in FIG. 1A, FIG. 1B, FIG. 1C, and FIG. 1D, butt pad base 100 may comprise a first marking face 105, a second marking face 110, a first slidable retention element 115, a first stock frame post attachment orifice 120, a second stock frame post attachment orifice 125, and a length of pull adjustment element attachment orifice 130. First marking face 105 may comprise a plurality of indexing elements 135 and a plurality of intermediate indexing elements 140. Second marking face 110 may comprise a plurality of indexing elements similar to plurality of indexing elements 135 and a plurality of intermediate indexing elements 140 similar to plurality of intermediate indexing elements 140.

As described in greater detail below, a first stock frame post 315 may attach to butt pad base 100 at first stock frame post attachment orifice 120. A second stock frame post 320 may attach to butt pad base 100 at second stock frame post attachment orifice 125. A length of pull adjustment element 325 may attach to butt pad base 100 at length of pull adjustment element attachment orifice 130.

Butt pad base 100 that may comprise a plate having first slidable retention element 115 comprising, for example, a male dovetail centered on first slidable retention element 115 and extending the full length of butt pad base 100. First slidable retention element 115 may comprise any type of slidable retention element including, but not limited to, a male dovetail or a female dovetail.

The width of first slidable retention element 115 may be less than that of butt pad base 100. Consequently, this difference in width may create flat features (e.g., first marking face 105 and second marking face 110) that may be perpendicular to a centerline of a profile of first slidable retention element 115. First marking face 105 may comprise an area onto which is engraved or otherwise formed plurality of indexing elements 135 and plurality of intermediate indexing elements 140.

Plurality of indexing elements 135 and plurality of intermediate indexing elements 140 may comprise a set of markings comprising a series of numbers and horizontal line segments extending, for example, the length of butt pad base 100. Plurality of indexing elements 135 and plurality of intermediate indexing elements 140 may be evenly spaced apart and plurality of intermediate indexing elements 140 may be respectively and evenly disposed between plurality of indexing elements 135. For example, as shown in the example of FIG. 1A and FIG. 1B, one of the plurality of indexing elements 135 may comprise "0" and subsequent ones of plurality of indexing elements 135 above and below "0" may be evenly graduated every 0.2 inches apart. Embodiments of the disclosure may use other units and may not be limited to inches.

Figure 2A:
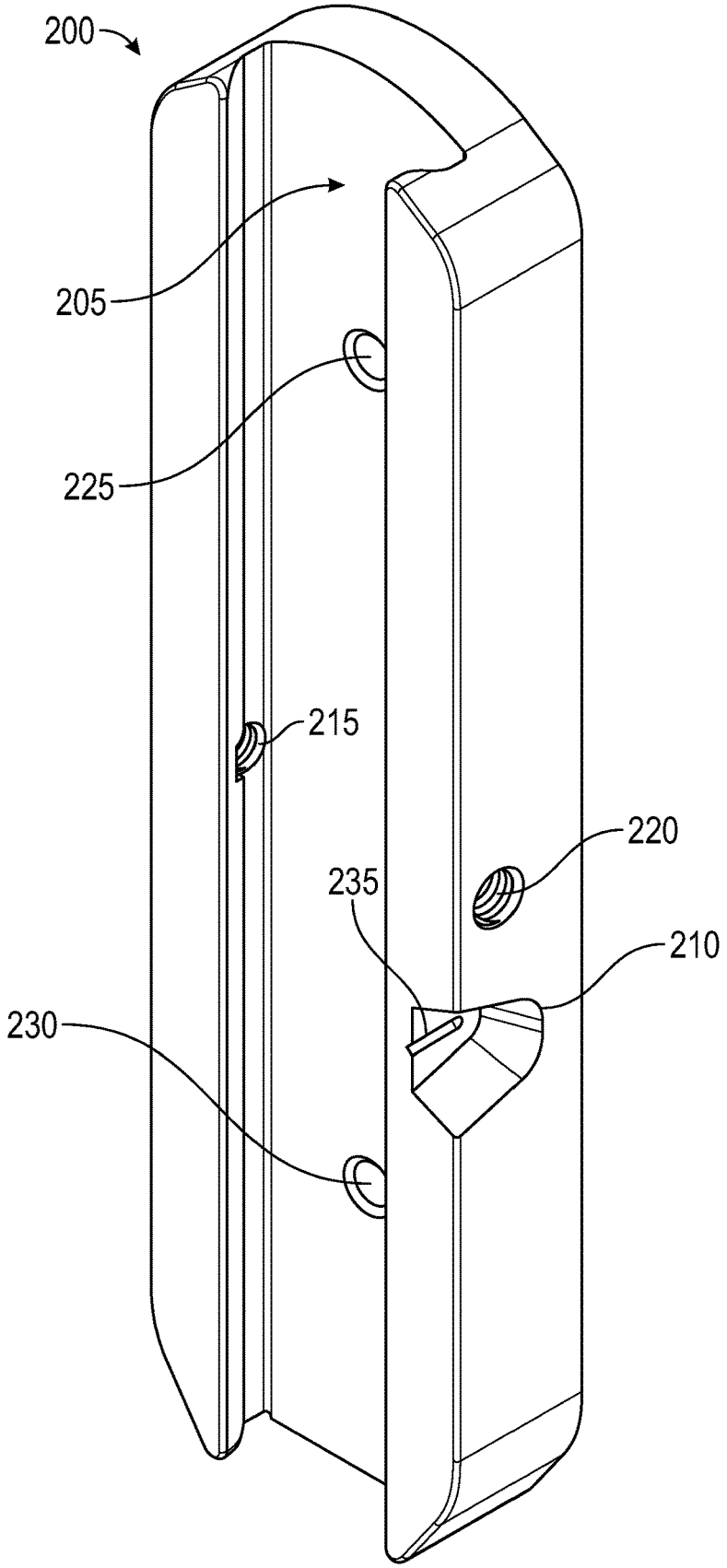
FIG. 2A shows an isometric view of a butt pad slide.
Figure 2B:
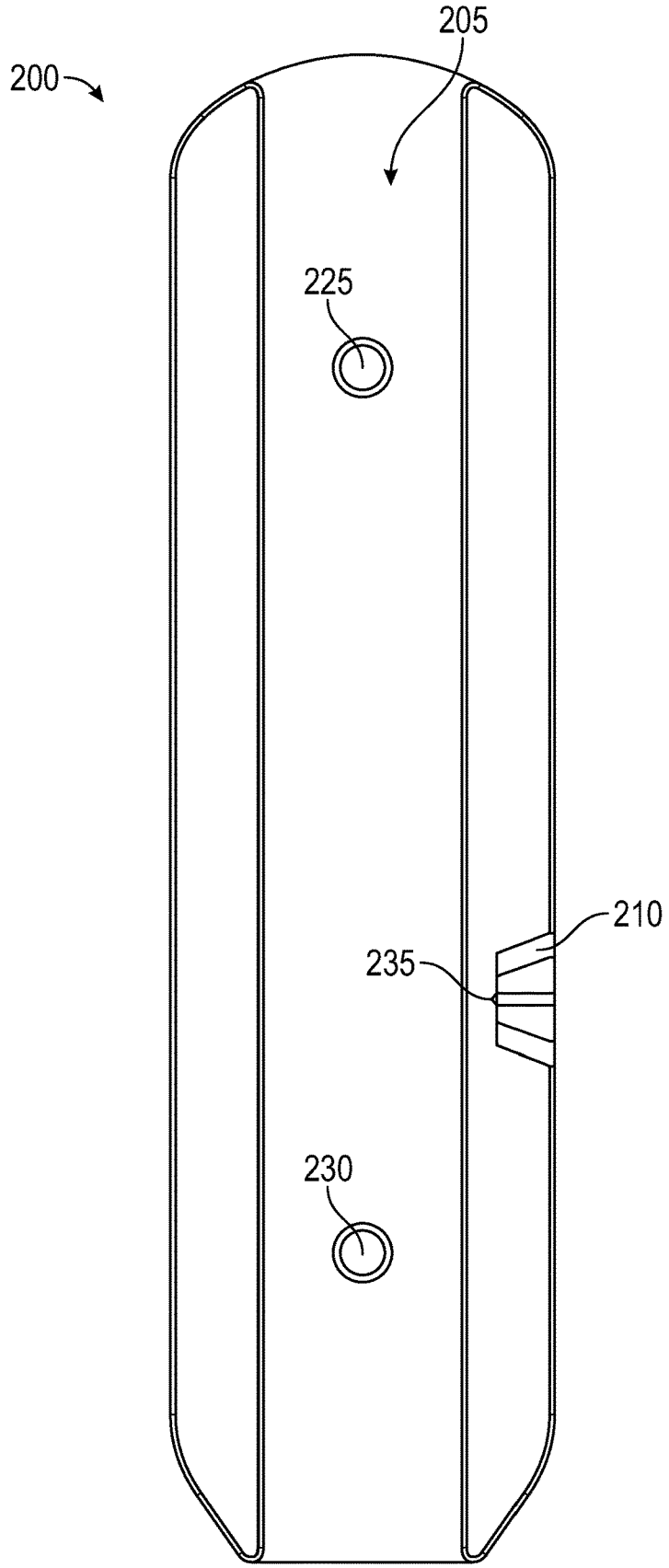
FIG. 2B shows a front view of a butt pad slide.
Figure 2C:
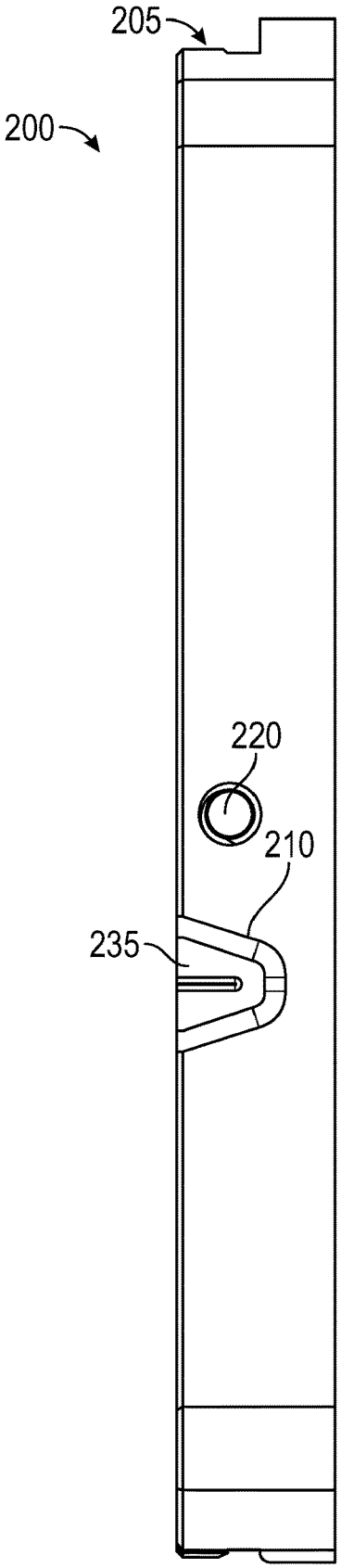
FIG. 2C shows a side view of a butt pad slide.
Figure 2D:
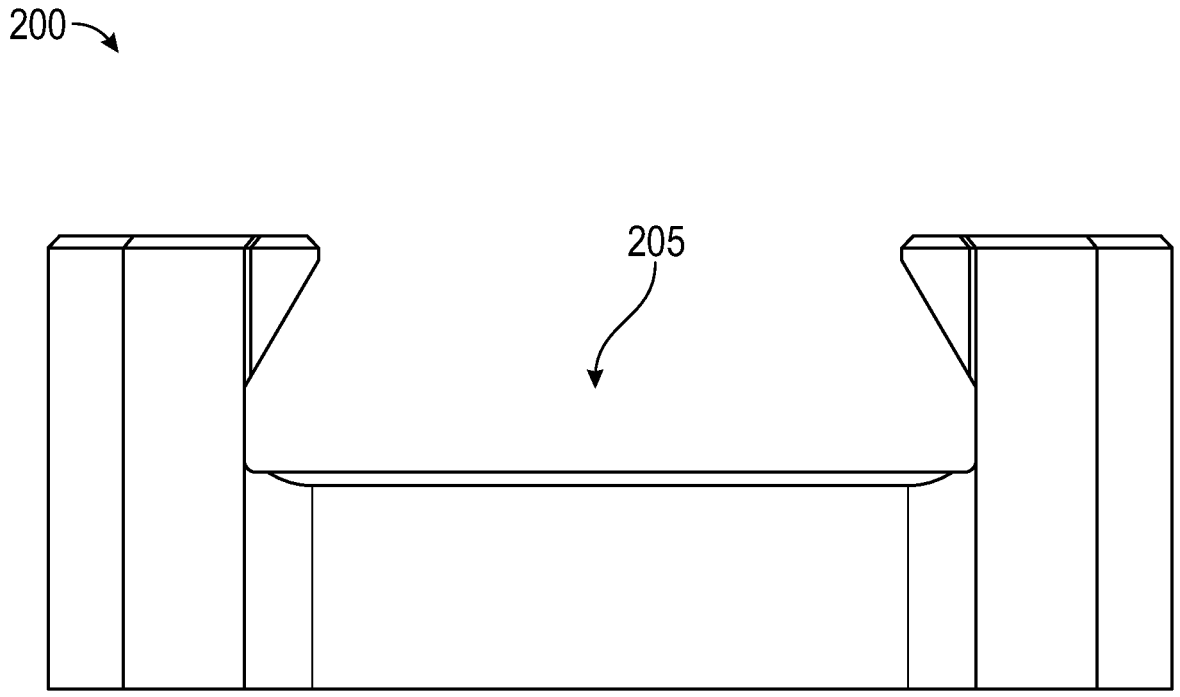
FIG. 2D shows a bottom view of a butt pad slide.

FIG. 2A, FIG. 2B, FIG. 2C, and FIG. 2D show a butt pad slide 200. FIG. 2A shows an isometric view of butt pad slide 200, FIG. 2B shows a front view of butt pad slide 200, FIG. 2C shows a side view of butt pad slide 200, and FIG. 2D shows a bottom view of butt pad slide 200. As shown in FIG. 2A, FIG. 2B, FIG. 2C, and FIG. 2D, butt pad slide 200 may comprise a second slidable retention element 205, a window 210, a first retention element orifice 215, a second retention element orifice 220, a first butt pad attachment orifice 225, and a second butt pad attachment orifice 230. Window 210 may comprise a pointer 235. Window 210 may be disposed on one or both sides of butt pad slide 200.

As described in greater detail below, a butt pad 305 may attach to butt pad slide 200 via first butt pad attachment orifice 225 and second butt pad attachment orifice 230. Also as described in greater detail below, a first locking element 335 or a second locking element 340 may be disposed in first retention element orifice 215 and/or second retention element orifice 220.

Second slidable retention element 205 may, fit around, slidably engage, and retain first slidable retention element 115. Second slidable retention element 205 may comprise, for example, a female dovetail centered on second slidable retention element 205 and extending the full length of butt pad slide 200. Second slidable retention element 205 may comprise any type of slidable retention element including, but not limited to, a male dovetail or a female dovetail. Butt pad slide 200 may comprise a block of overall height and width equal to that of butt pad base 100 and may comprise a female dovetail feature corresponding to the male dovetail feature of butt pad base 100. Butt pad slide 200 may also comprise a primary "notch cut" feature (e.g., window 210) that may be located on one of both sides of butt pad slide 200. Window 210 may include a secondary notch cut feature (e.g., pointer 235). At least a portion of first marking face 105 or second marking face 110 may be viewable through window 210 exposing ones of plurality of indexing elements 135 and ones of plurality of intermediate indexing elements 140 in window 210.

Figure 3A:
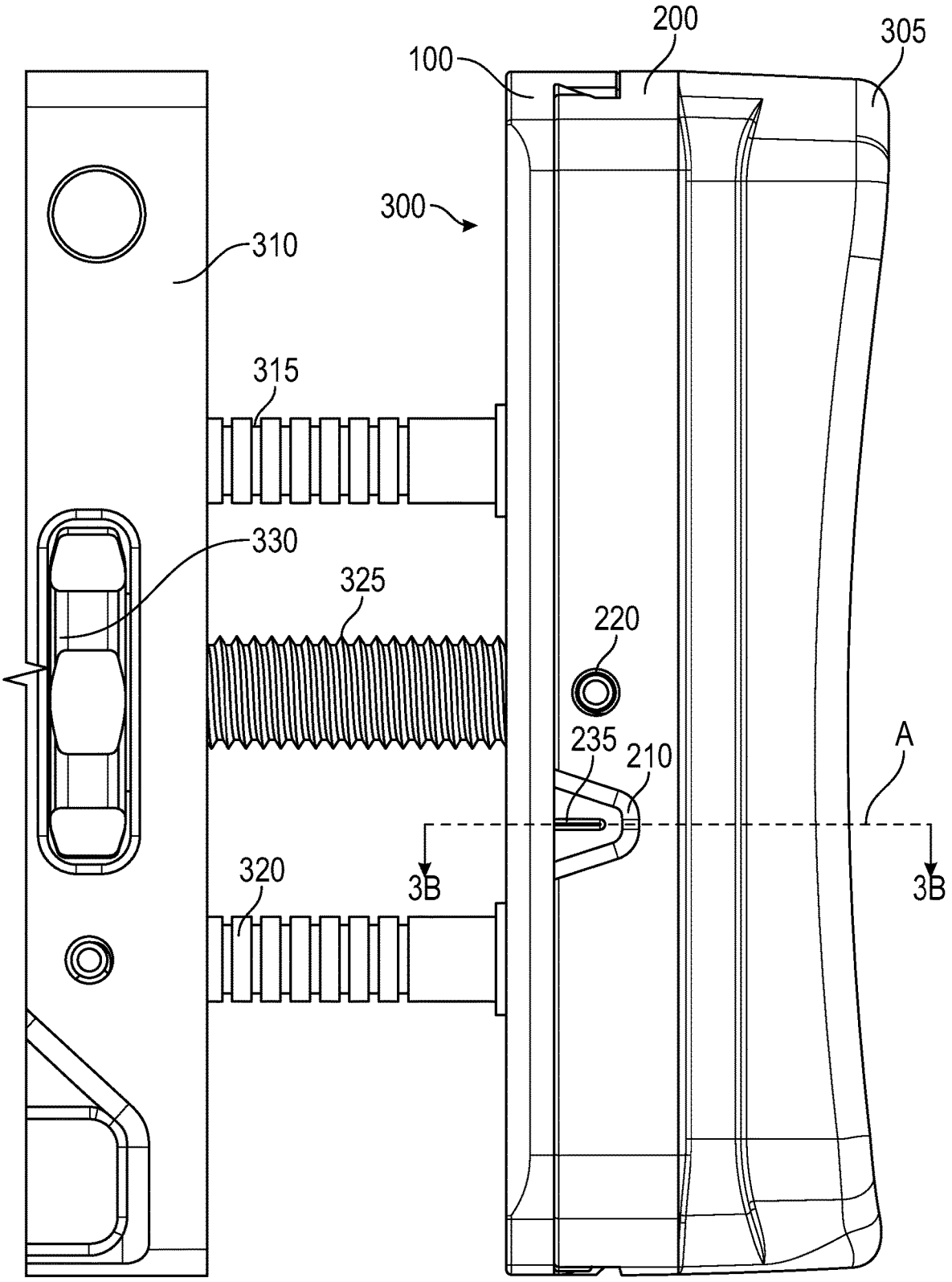
FIG. 3A shows a side view of a butt assembly in a zero position.
Figure 3B:
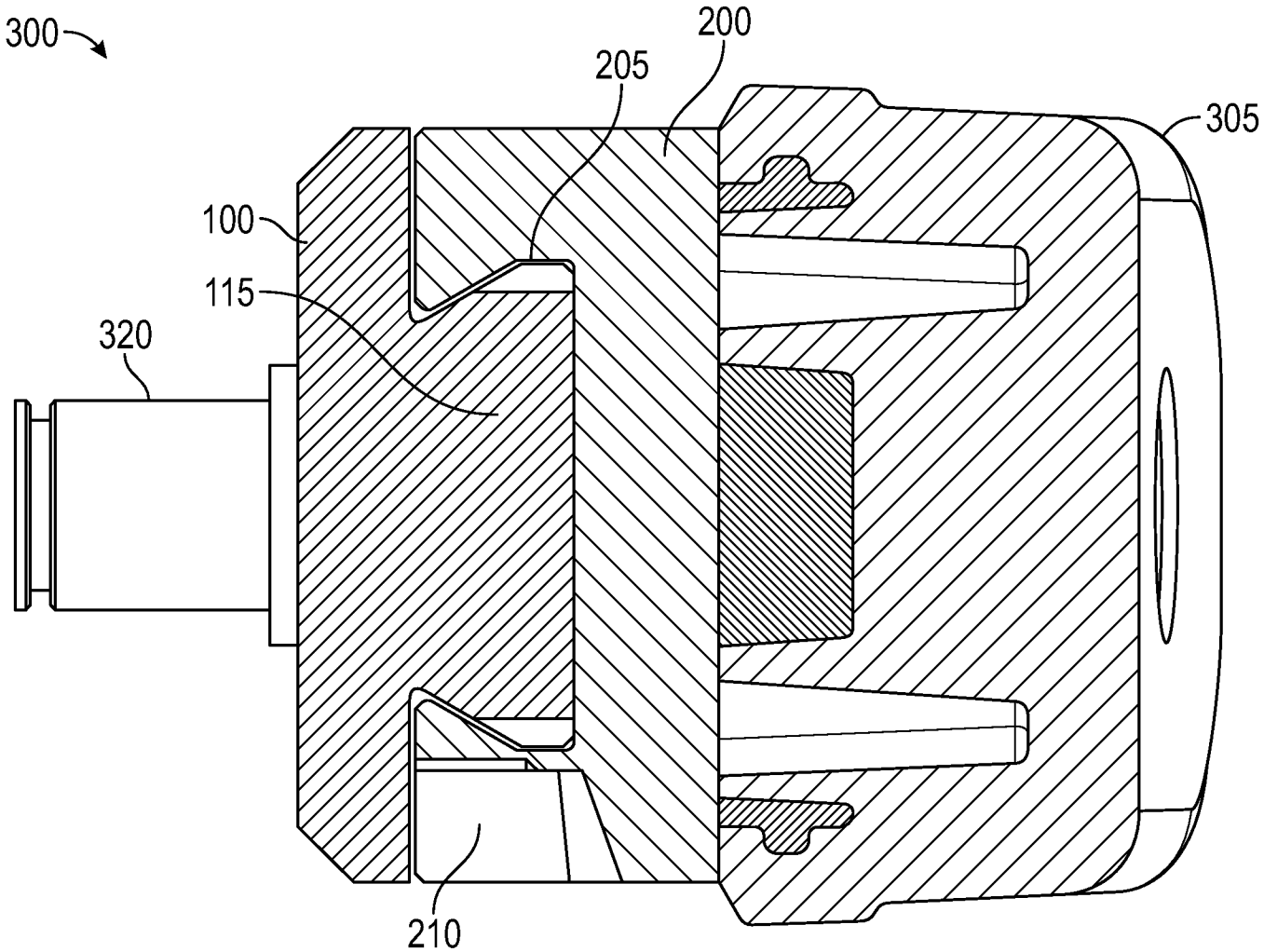
FIG. 3B shows a cross section of a side view of a butt assembly in a zero position.
Figure 4A:
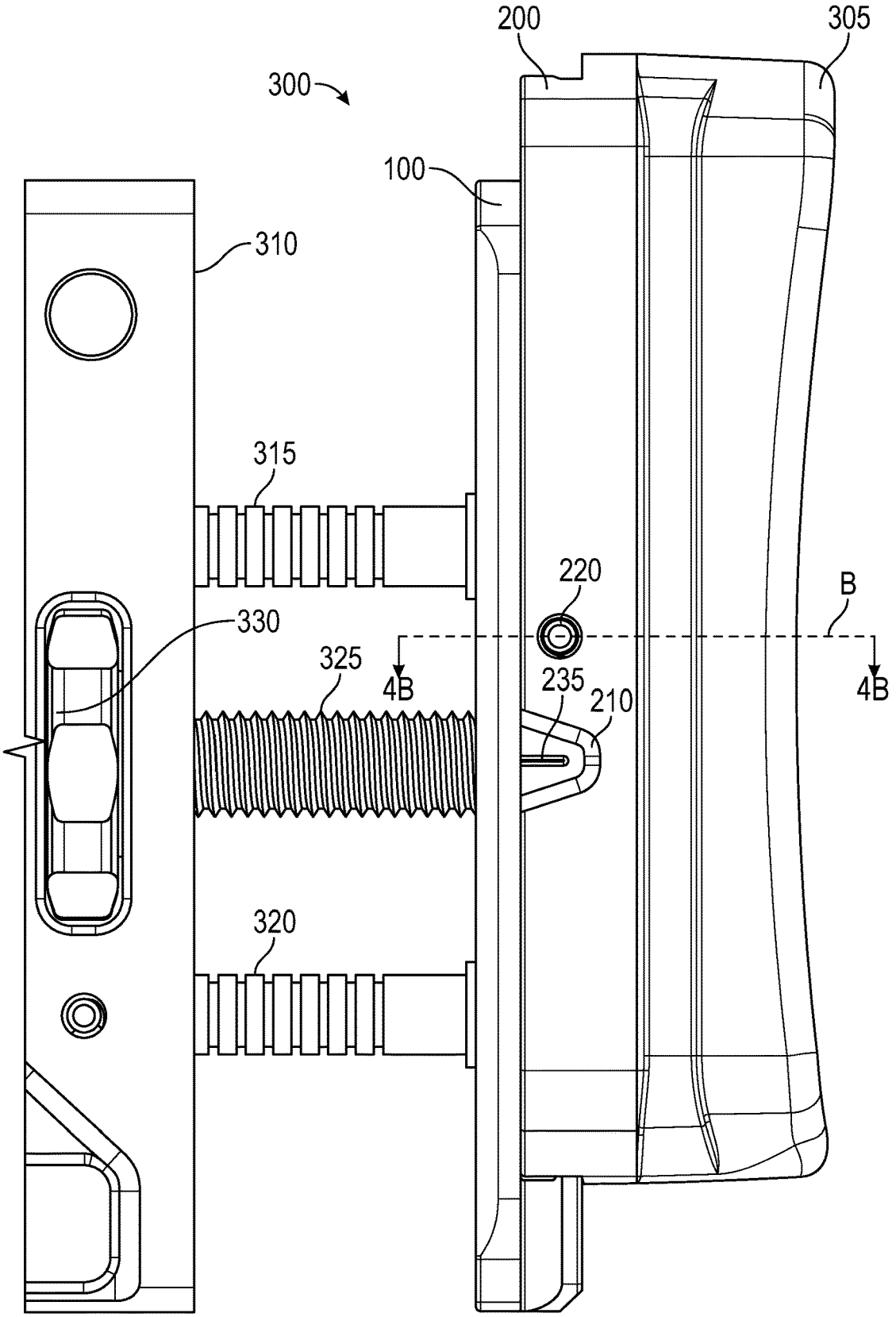
FIG. 4A shows a side view of a butt assembly in a non-zero position.
Figure 4B:
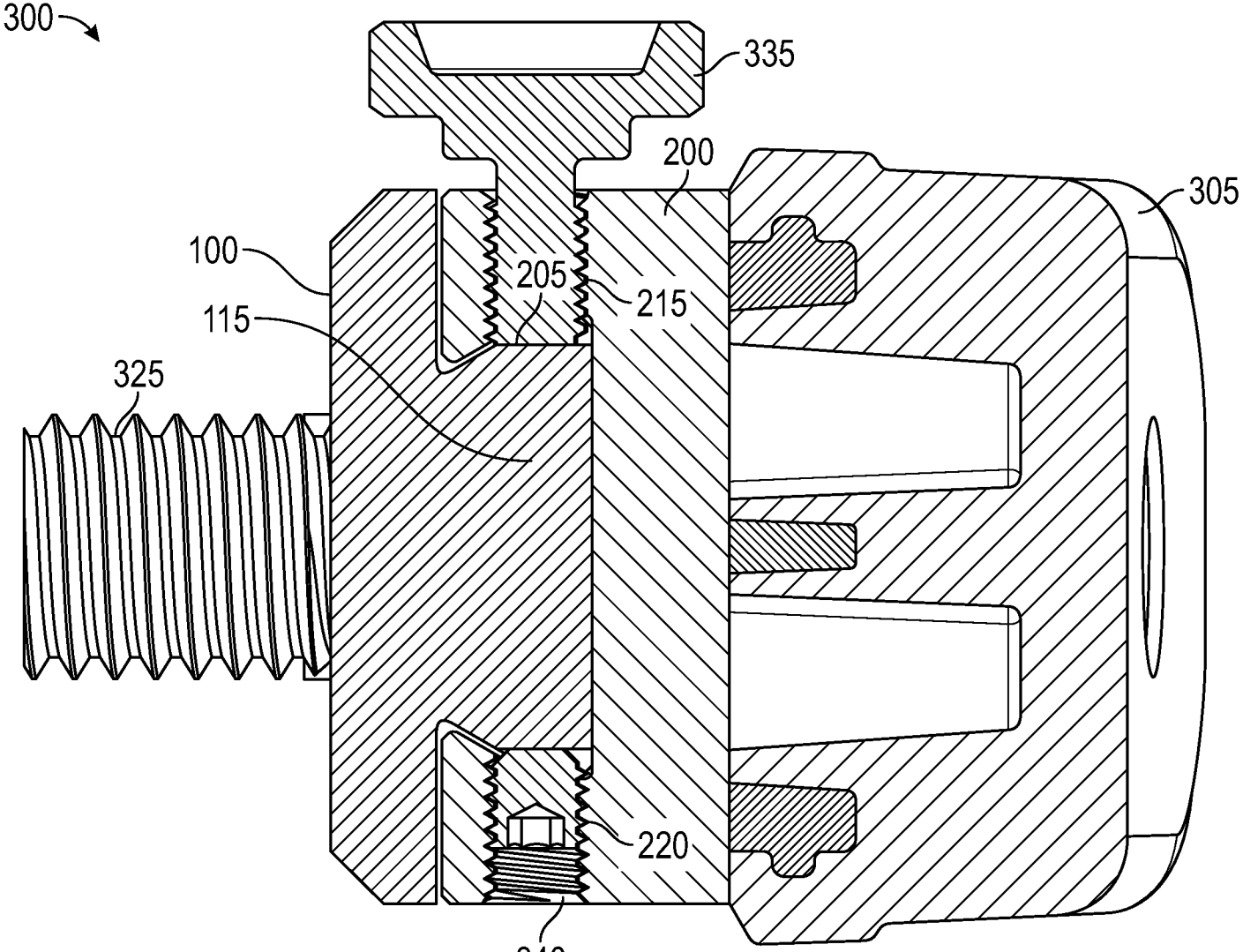
FIG. 4B shows a cross section of a side view of a butt assembly in a non-zero position.
Figure 5:
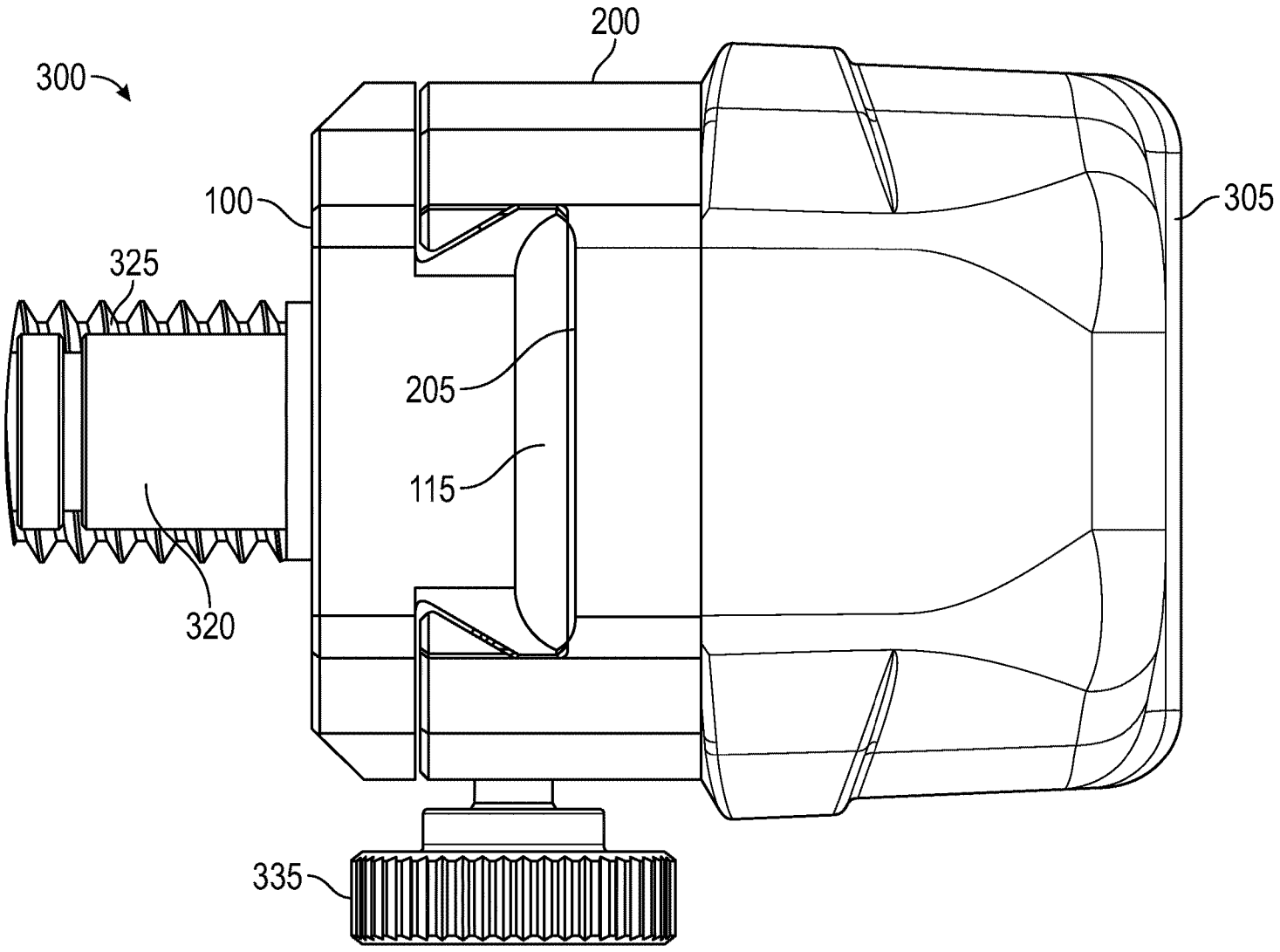
FIG. 5 shows a bottom view of a butt assembly.

FIG. 3A, FIG. 3B, FIG. 4A, FIG. 4B, and FIG. 5 show a butt assembly 300. FIG. 3A shows a side view of butt assembly 300 in a zero position. FIG. 3B shows a cross section of a side view of butt assembly 300 in a zero position (cross section "A" from FIG. 3A). FIG. 4A shows a side view of butt assembly 300 in a non-zero position. FIG. 4B shows a cross section of a side view of butt assembly 300 in a non-zero position (cross section "B" from FIG. 4A). FIG. 5 shows a bottom view of butt assembly 300. As shown in FIG. 3A, FIG. 3B, FIG. 4A, FIG. 4B, and FIG. 5, butt assembly 300 may comprise butt pad base 100, butt pad slide 200, and butt pad 305. FIG. 3A, FIG. 3B, FIG. 4A, and FIG. 4B further illustrate a stock frame 310, a first stock frame post 315, a second stock frame post 320, a length of pull adjustment element 325, a length of pull adjustment wheel 330. FIG. 4B, and FIG. 5 further illustrate first locking element 335, and second locking element 340.

Butt assembly 300 may be attached to stock frame 310 via first stock frame post 315 and second stock frame post 320. First locking element 335 may comprise, but is not limited to, a screw and length of pull adjustment wheel 330 may comprise, but is not limited to, a corresponding nut associated with first locking element 335. As length of pull adjustment wheel 330 is adjusted (e.g., rotated clockwise or counter clockwise), the horizontal distance between butt assembly 300 and stock frame 310 may be correspondingly adjusted.

When butt pad base 100 and butt pad slide 200 are joined via engagement between their respective slidable retention elements (i.e., respective dovetail features), window 210 of butt pad slide 200 may reveal an area of first marking face 105 or second marking face 110 onto which plurality of indexing elements 135 and plurality of intermediate indexing elements 140 may be marked, allowing a portion of plurality of indexing elements 135 and plurality of intermediate indexing elements 140 to be displayed and viewed by a user. As either of the two parts (i.e., butt pad base 100 and butt pad slide 200) move, constrained by their mating respective slidable retention elements (i.e., respective dovetail features), pointer 235 in window 210 of butt pad slide 200 may be brought into alignment with the line segment markings (e.g., ones of plurality of indexing elements 135 and plurality of intermediate indexing elements 140) on butt pad base 100. This may provide a visible indication of the position of the two parts (i.e., butt pad base 100 and butt pad slide 200) relative to each other. In the context of integrating butt assembly 300 in rifle stock frame 310, embodiments of the disclosure may provide the user with a numbered or otherwise positively or negatively identifiable reading of a vertical position of the rifle's butt pad 305.

Figure 6A:
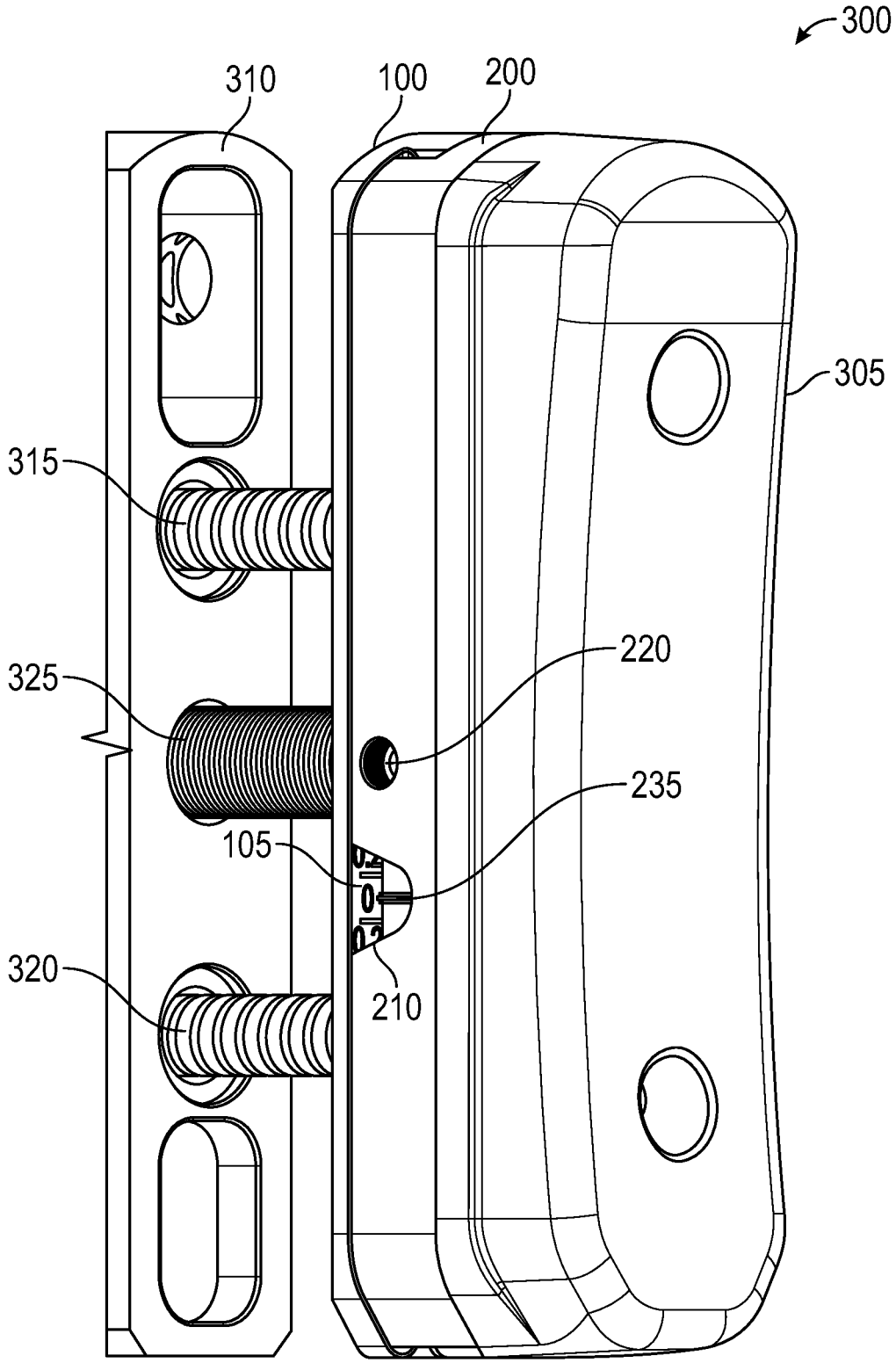
FIG. 6A shows an isometric view of a butt assembly in a zero position.
Figure 6B:
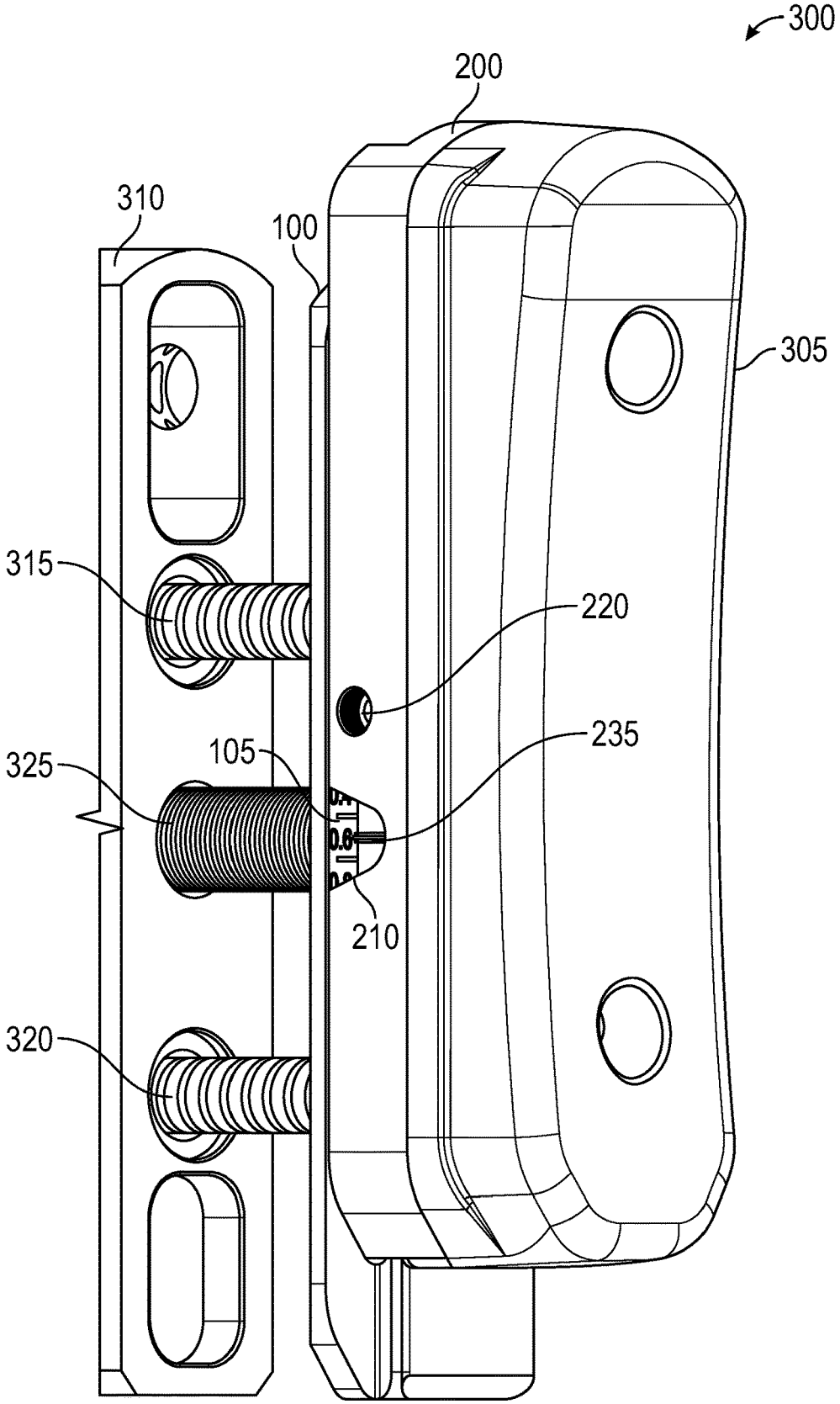
FIG. 6B shows an isometric view of a butt assembly in a non-zero position.
Figure 7:
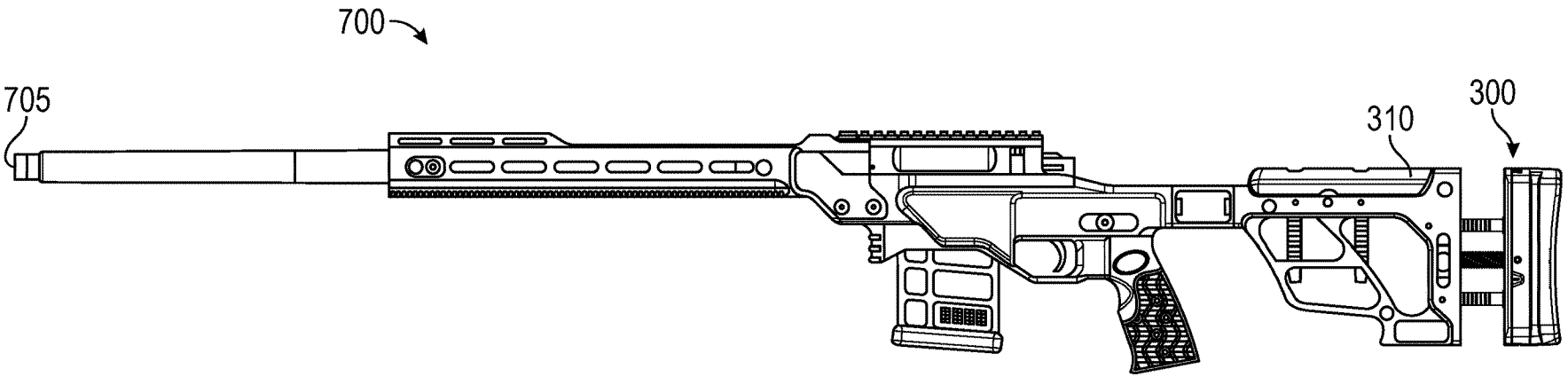
FIG. 7 shows a side view of a butt assembly disposed on a rifle.

FIG. 6A shows an isometric view of butt assembly 300 in a zero position and FIG. 6B shows an isometric view of butt assembly 300 in a non-zero position. FIG. 7 shows a side view of butt assembly 300 disposed on a rifle 700 that includes a bore 705. Embodiments of the disclosure may include butt pad base 100 that may have height position markings (e.g., plurality of indexing elements 135 and plurality of intermediate indexing elements 140) for indicating a vertical position of butt pad 305. When butt assembly 300 is assembled as part of stock frame 310 of rifle 700, the height position markings (e.g., plurality of indexing elements 135 and plurality of intermediate indexing elements 140) may be oriented other than parallel to a side of stock frame 310 or rifle 700.

The user of rifle 700 may loosen first locking element 335 and/or second locking element 340 to allow first slidable retention element 115 and second slidable retention element 205 to slide with respect to one another. This may allow the user to line pointer 235 with ones of plurality of indexing elements 135 and plurality of intermediate indexing elements 140. Pointer 235 lining up to the ones of plurality of indexing elements 135 and plurality of intermediate indexing elements 140 may indicate a distance a top of butt pad 305 attached to butt pad slide 200 is above a center of bore 705 of rifle 700 or below the center of bore 705 of rifle 700.

As shown in FIG. 6A, for example, pointer 235 may be lined up with the "0" indexing element. This may indicate that the top of butt pad 305 may be with a center of bore 705 of rifle 700. Similarly, as shown in FIG. 6B, pointer 235 may be lined up with the "0.6" indexing element. This may indicate that the top of butt pad 305 may be 0.6 inches above the center of bore 705 of rifle 700. Lining up pointer 235 with the intermediate indexing element between indexing element "0.6" and indexing element "0.8" above the "0" indexing element may indicate the top of butt pad 305 may be 0.7 inches above the center of bore 705 of rifle 700. Once the user of rifle 700 lines pointer 235 with a desired indexing element or intermediate indexing element, the user may tighten first locking element 335 and/or second locking element 340 to inhibit first slidable retention element 115 and the second slidable retention element 205 from sliding with respect to one another.

Consistent with embodiments of the disclosure, a plane containing a line passing through a center of bore 705 of rifle 700 may be substantially perpendicular to a plane containing first marking face 105 and/or second marking face 110. Consequently, embodiments of the disclosure may allow for accurate, repeatable positioning of vertically adjustable butt assembly 300 in such a way that the markings (e.g., plurality of indexing elements 135 and plurality of intermediate indexing elements 140) are obscured from immediate view except as needed for positioning (aesthetically cleaner), and are protected from being rendered illegible over time due to abrasion/wearing off from normal handling/use, or by being covered by dirt/mud/debris, etc.

Rifle 700 may comprise, for example, a bolt action firearm or a self-loading firearm that may comprise, for example, a semi-automatic rifle or a fully-automatic rifle. Embodiments of the disclosure are not limited to an particular types of firearms and may be used on any other types of firearms including, but not limited to, shotguns, carbines, and pistols for example.

Embodiments of the present disclosure, for example, are described above with reference to block diagrams and/or operational illustrations of methods and systems, according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. A apparatus comprising:
a butt pad base comprising,
a first slidable retention element, and
a marking face; and
a butt pad slide comprising,
a second slidable retention element that slidably engages and retains the first slidable retention element, and
a window through which at least a portion of the marking face is viewable.

2. The apparatus of claim 1, wherein the marking face comprises a plurality of indexing elements.

3. The apparatus of claim 2, wherein the plurality of indexing elements are evenly spaced apart.

4. The apparatus of claim 2, wherein the marking face comprises a plurality of intermediate indexing elements respectively disposed between the plurality of indexing elements.

5. The apparatus of claim 1, wherein the butt pad slide further comprises a pointer disposed in the window.

6. The apparatus of claim 5, wherein the pointer is configured to line up with ones of a plurality of indexing elements disposed on the marking face.

7. The apparatus of claim 6, wherein the pointer lining up to the ones of the plurality of indexing elements indicates a distance a top of a butt pad attached to the butt pad slide is one of the following: above a center of a bore of a firearm the apparatus is disposed on and below the center of the bore of the firearm the apparatus is disposed on.

8. The apparatus of claim 5, wherein the pointer is configured to line up with ones of a plurality of intermediate indexing elements respectively disposed between the plurality of indexing elements, the plurality of indexing elements and the plurality of intermediate indexing elements being disposed on the marking face.

9. The apparatus of claim 1, further comprising a butt pad attached to the butt pad slide.

10. The apparatus of claim 1, further comprising a locking element configured to inhibit the first slidable retention element and the second slidable retention element from sliding with respect to one another.

11. The apparatus of claim 10, wherein the locking element comprises a thumb screw.

12. The apparatus of claim 10, wherein the locking element comprises a set screw.

13. The apparatus of claim 10, wherein the locking element is disposed in the butt pad slide.

14. The apparatus of claim 1, wherein the first slidable retention element comprises one of the following: a male dove tail and a female dove tail.

15. The apparatus of claim 1, wherein the second slidable retention element comprises one of the following: a male dove tail and a female dove tail.

16. The apparatus of claim 1, wherein the apparatus is disposed on a firearm wherein a plane containing a line passing through a center of a bore of the firearm is substantially perpendicular to a plane containing the marking face.

17. A apparatus comprising:
a butt pad base comprising,
a first slidable retention element, and
a marking face;
a butt pad slide comprising,
a second slidable retention element that slidably engages and retains the first slidable retention element; and
a window through which at least a portion of the marking face is viewable, wherein the apparatus is disposed on a firearm wherein a plane containing a line passing through a center of a bore of the firearm is substantially perpendicular to a plane containing the marking face.

18. The apparatus of claim 17, wherein the butt pad slide further comprises a pointer disposed in the window wherein the pointer is configured to line up with ones of a plurality of indexing elements disposed on the marking face.

19. A apparatus comprising:
a butt pad base comprising,
a first slidable retention element, wherein the first slidable retention element comprises a male dove tail, and
a marking face wherein the marking face comprises a plurality of indexing elements;
a butt pad slide comprising,
a second slidable retention element that slidably engages and retains the first slidable retention element wherein the second slidable retention element comprises a female dove tail, and
a window through which at least a portion of the marking face is viewable wherein the butt pad slide further comprises a pointer disposed in the window;
a butt pad attached to the butt pad slide wherein the pointer is configured to line up with ones of the plurality of indexing elements disposed on the marking face wherein the pointer lining up to the ones of the plurality of indexing elements indicates a distance a top of the butt pad attached to the butt pad slide is one of the following: above a center of a bore of a firearm the apparatus is disposed on and below the center of the bore of the firearm the apparatus is disposed on; and
a locking element configured to inhibit the first slidable retention element and the second slidable retention element from sliding with respect to one another wherein the locking element comprises one of the following: a thumb screw and a set screw.

20. The apparatus of claim 19, wherein a plane containing a line passing through the center of the bore of the firearm is substantially perpendicular to a plane containing the marking face.

* * * * *